US010608371B1

(12) United States Patent
Ramotowski

(10) Patent No.: US 10,608,371 B1
(45) Date of Patent: Mar. 31, 2020

(54) UNDERSEA CABLE CONNECTOR WITH INTERNAL DEBONDING PREVENTION

(71) Applicant: The United States of America as represented by the Secretary of the Navy, Newport, RI (US)

(72) Inventor: Thomas S Ramotowski, Tiverton, RI (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 15/996,641

(22) Filed: Jun. 4, 2018

(51) Int. Cl.
*H01R 13/523* (2006.01)
*H01R 43/00* (2006.01)
*H01R 13/52* (2006.01)

(52) U.S. Cl.
CPC ..... *H01R 13/523* (2013.01); *H01R 13/5205* (2013.01); *H01R 43/005* (2013.01)

(58) Field of Classification Search
CPC .. H01R 13/46; H01R 13/5025; H01R 13/504; H01R 13/52; H01R 13/5202; H01R 13/5205; H01R 13/5208; H01R 13/521; H01R 13/5216; H01R 13/5219; H01R 13/5221; H01R 13/523; H01R 13/533
See application file for complete search history.

(56) References Cited

U.S. PATENT DOCUMENTS 4,874,324 A * 10/1989 Andersen ..... H01R 13/523 439/271
5,942,333 A * 8/1999 Arnett ..... B05B 7/20 428/461
7,128,017 B2 * 10/2006 Guarino ..... H01R 13/521 114/312
7,253,745 B2 * 8/2007 Hall ..... E21B 17/028 166/178
7,437,819 B1 * 10/2008 Escobedo ..... H01R 13/523 264/272.2
7,942,696 B2 * 5/2011 Watson ..... E21B 17/023 439/589
8,303,340 B2 * 11/2012 Seiler ..... H01R 13/5205 439/271
8,887,388 B2 * 11/2014 Van Swearingen .... H01R 4/029 29/860
9,368,929 B2 * 6/2016 Matsushita ..... H01R 11/12
(Continued)

OTHER PUBLICATIONS

Unknown, "Cathodic Delamitiation," capture from http://seaconworldwide.com/cathodic-delaminations/,Jun. 12, 2019. See pp. 2 and 3.

*Primary Examiner* — Edwin A. Leon
*Assistant Examiner* — Matthew T Dzierzynski
(74) *Attorney, Agent, or Firm* — James M. Kasischke; Michael P. Stanley

(57) ABSTRACT

An electrical connector for joining a cable to a cathodically protected body in a marine environment includes a connector body having a terminal connector for joining to the cathodically protected body and a mounting portion for receiving the cable. An elastomeric band is positioned around said connector body mounting portion and exerts radially compressive inward force thereupon. An encapsulant is formed around and bonded to said connector body mounting portion, said elastomeric band and the cable. A method for making the electrical connector is further provided.

6 Claims, 2 Drawing Sheets

(56) References Cited

U.S. PATENT DOCUMENTS

| | | | | |
|---|---|---|---|---|
| 9,647,382 | B2 * | 5/2017 | Nabeta | H01R 4/185 |
| 9,716,338 | B2 * | 7/2017 | Brown | H01R 39/64 |
| 9,941,624 | B2 * | 4/2018 | Zhang | H01R 13/5221 |
| 10,096,986 | B2 * | 10/2018 | Wimmer | H01B 1/02 |
| 2001/0051452 | A1 * | 12/2001 | Walker | F16L 5/00 439/248 |
| 2014/0199775 | A1 * | 7/2014 | Bagley | C09D 5/08 436/163 |
| 2015/0021090 | A1 * | 1/2015 | Mano | H01R 4/185 174/72 A |
| 2018/0163728 | A1 * | 6/2018 | Zugelder | E21B 43/12 |
| 2018/0248306 | A1 * | 8/2018 | Franke | H01R 13/504 |

* cited by examiner

UNDERSEA CABLE CONNECTOR WITH INTERNAL DEBONDING PREVENTION

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention is directed to connectors for undersea cables and more particularly to a method for increasing the lifespan for such connectors.

(2) Description of the Prior Art

FIG. 1 shows a prior art electrical connector 10 joined to a cable 12 for use in the marine environment. Cable 12 has a plurality of electrical elements 14 that terminate in a connector body 16. Connector body 16 consolidates elements 14 so that they can be attached to a fixture or another cable. Connector body 16 is hollow with a terminal connector 18 and a mounting portion 20. Terminal connector 18 can be joined using many different methods. Connector body 16 is typically made from a corrosion resistant metal; however, other anticorrosion measures are taken, as described hereafter. Elements 14 from cable 12 extend into hollow mounting portion 20. In this embodiment, elements 14 are terminated as male pins 22 within connector body 16, but these can also be terminated as female sockets (not shown). Pins 22 or other terminations are sealed to prevent water leaking into the connector body 16 hollow. Pins 22 or other terminations can be joined to a complementary connector on a platform.

After assembly of the cable 12 with connector body 16, an encapsulant 24 is molded around mounting portion 20 and cable 12 in order to seal the junction between cable 12 and connector body 16. Encapsulant 24 is typically polyurethane or another polymer. Encapsulant 24 is bonded to the cable 12 and mounting portion 20 of connector body 16 and fills substantially all of the volume of this junction. Bonding of the encapsulant to the cable 12 and the connector body 16 is critical for preventing leakage of seawater into the region where the elements 14 extend into hollow mounting portion 20.

Cathodic debonding (sometimes also called "cathodic delamination") is a major cause for the premature failure of these connectors in the marine environment. Preventing this failure has been a subject of extensive research. This research has determined that the process occurs because the hulls of ships and submarines are deliberately cathodically polarized via sacrificial anodes or an induced current cathodic protection (ICCP) system to prevent hull corrosion in seawater. The net effect is the conversion of the hull from being an anode (i.e., subject to corrosion) to being a cathode (i.e., protected from corrosion). At the voltages normally used, the cathodically protected hulls support the following half-cell reaction on their exposed metal surfaces:

$$O_2+2H_2O+4e^- \rightarrow 4(OH)^- \quad (1)$$

Equation (1) does not harm the metal surface. It does, however, result in the generation of a very high pH environment immediately above the metal surface. Any hardware (such as a cable connector or hull penetrator) electrically connected to the cathodically polarized metal surface of the platform can pick up the cathodic current and thus becomes cathodically polarized itself. The concentrated alkaline environment that forms immediately above cathodically polarized metal surfaces can destabilize metal-oxide layers, break metal-polymer bonds, and in some cases, attack or damage polymers directly. High pH environments are detrimental to most polymer-metal bonds. They can cause paint to fall off of cathodically polarized hardware, and they can cause polymer encapsulants to debond from connector backshells such as mounting portion 20. This often results in flooding of the connector and failure.

Referencing FIG. 1, cathodic debonding on outboard cable connectors proceeds inward from the exposed metal-polymeric encapsulant bond-line/interface 26. Since the required reactants for the debonding process, water and oxygen, can permeate through the polymeric encapsulant, and the electrons (current) come through the metal substrate, it has been a longstanding mystery as to why cathodic debonding only occurs through exposed bond lines. Cathodic debonding doesn't happen where encapsulant 24 contacts cable 12 because the cable jacket and encapsulant 24 are insulators.

Experimental testing has confirmed that cathodic debonding rates are dependent on electrolyte concentration. As the concentration of the electrolyte increases, so does the rate of debonding. The debonding rate drops to zero when the concentration of the electrolyte drops to zero. The dependence of the debonding rate on the concentration of the electrolyte is of interest, because in equation (1) the cathodic reaction that causes debonding does not include sodium ($Na^+$) or chlorine ($Cl^-$) ions, the two ions comprising the electrolyte. Experimental testing also found that the debonding relationship is linear with respect to the square root of time. This suggests that a diffusion reaction is in control of the debonding rate.

A possible reason for the dependence of the debonding rate on the electrolyte concentration is that the right side of equation (1) is not charge-balanced. The cathodic debonding reaction generates negatively charged hydroxide ions ($OH^-$). Those negative charges need to be cancelled out or balanced by an equal number of positive charges. The only significant source of positively charged ions is the electrolyte. Some of its positively charged metal ions ($M^+$) migrate to the region of active debonding to provide the needed charge balance.

The size of the $M^+$ cation also influences the rate of cathodic debonding. When the $M^+$ cation is lithium ($Li^+$), the rate of cathodic debonding is lower than when the $M^+$ cation is potassium ($K^+$). This is unexpected because the +1 cation for lithium is smaller than the +1 cation for potassium. Smaller species such as lithium ions should diffuse faster than larger species such as potassium ions; however, if one considers the size of the M+ cation and its associated sphere of hydration, the results make better sense. The sphere of hydration is the volume of water molecules associated with the $M^+$ cation when it is dissolved in water. Lithium ions ($Li^+$) have a larger sphere of hydration than potassium ions ($K^+$). Because they have much larger spheres of hydration due to their greater positive charge, $M^{+2}$ cations (e.g., zinc, $Zn^{+2}$ from sacrificial zinc anodes) would not be expected to play much of a role in providing charge balance for the cathodic debonding reaction.

This analysis has determined that the $M^+$ charge balancing cations diffuse through the bond-line/interface 26 between the metal surface of the connector mounting portion 20 and encapsulant 24 to keep the actively debonding region electrically neutral. Thus, the $M^+$ ions move between connector mounting portion 20 and encapsulant 24 after the debonding front has passed through. The need for this cation migration to occur would also explain the diffusion-control of the rate of the debonding, and it also explains that cathodic debonding on outboard electronic cable connectors begins at an exposed polymeric encapsulant/metal backshell interface/bond line 26 because charged species like $M^+$ cannot diffuse through encapsulant 24 polymers. These species must diffuse through the disrupted, former bondline. The resulting equation is:

$$O_2+2H_2O+4e^-+4M^+\rightarrow 4(OH^-)+4M^+ \quad (2)$$

Controlling this action provides a method for avoiding cathodic debonding and preserving the life of marine electrical connectors.

SUMMARY OF THE INVENTION

It is a first object of the present invention to provide a connector that has extended life when joined to a cathodically protected platform.

Another object is to provide a method for protecting existing connectors that will be joined to cathodically protected platforms.

Accordingly, there is provided an electrical connector for joining a cable to a cathodically protected body in a marine environment that includes a connector body having a terminal connector for joining to the cathodically protected body and a mounting portion for receiving the cable. An elastomeric band is positioned around the connector body mounting portion and exerts radially inward force thereupon. An encapsulant is formed around and bonded to the connector body mounting portion, elastomeric band, and cable.

A method for making such connectors is also provided. In such a method, a connector body having a mounting portion and a terminal connector for joining to an external fixture is provided. An elastomeric band is provided around said connector body mounting portion whereby the elastomeric band provides a radially inward force about the connector body mounting portion. A cable having at least one element is received in the connector body mounting portion, and the cable element is assembled in the terminal connector. An encapsulant is molded about the assembled connector body mounting portion with the positioned elastomeric band and received cable such that the encapsulant is bonded to the connector body mounting portion, elastomeric band, and cable.

BRIEF DESCRIPTION OF THE DRAWINGS

Reference is made to the accompanying drawings in which are shown an illustrative embodiment of the invention, wherein corresponding reference characters indicate corresponding parts, and wherein.

DETAILED DESCRIPTION OF THE INVENTION

Figure 1:
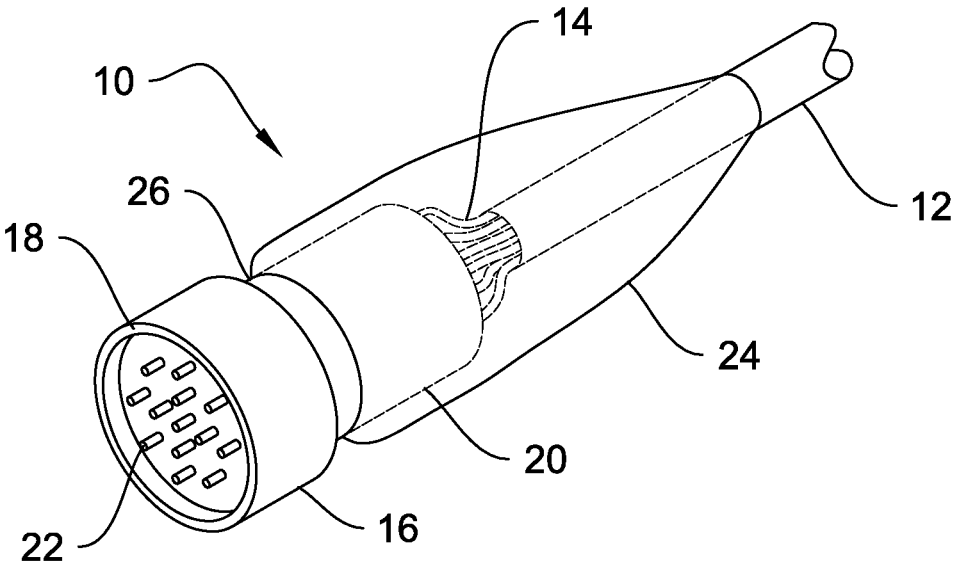
FIG. 1 (PRIOR ART)
FIG. 1 is a diagram showing a prior art connector subject to cathodic delamination.
Figure 2:
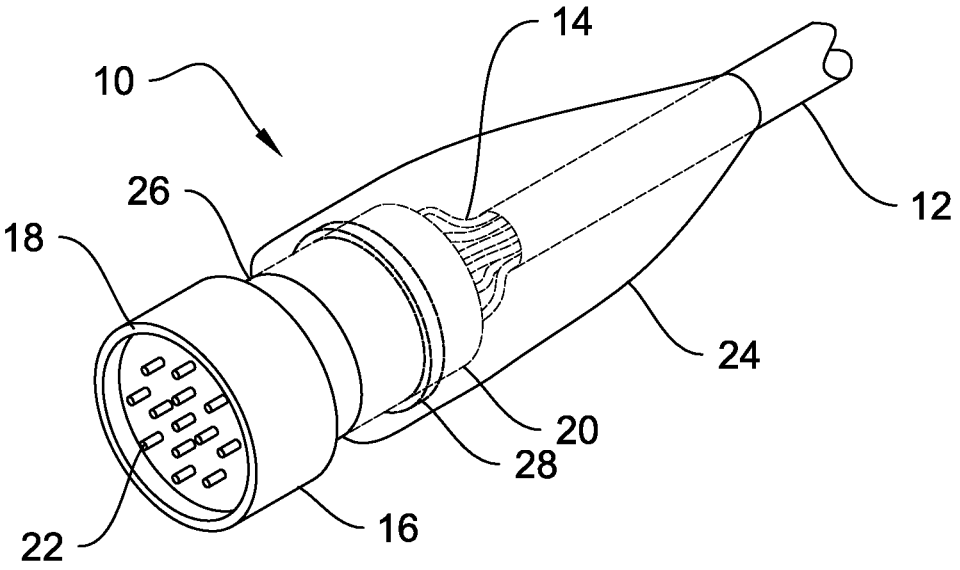
FIG. 2 is a diagram showing a first embodiment of a connector protected against cathodic delamination.

FIG. 2 suggests a method by which cathodic debonding can be stopped. If the flow of $M^+$ charge balance cations to the site of active debonding is disrupted, the cathodic debonding process slows or completely stops. This is easier than trying to stop the movement of the oxygen ($O_2$) and water ($H_2O$) needed for the cathodic delamination reaction to occur. Because oxygen and water are either uncharged or possess a small dipole, they can diffuse through polymers, whereas $M^+$ cations, being charged, cannot.

FIG. 2 shows application of a band 28 applying a radial compression or inwardly directed force to the connector body 16 mounting portion 20. Band 28 should be applied in the region of mounting portion 20 that will be covered by encapsulant 24. Compression between band 28 and mounting portion 20 prevents entry of metallic ions and further debonding of encapsulant 24 in the region of mounting portion 20 between band 28 and cable 12. Band 28 is preferably made from an elastomeric material that applies compressive forces to metallic portion 20. These compressive force cause slight deformation of band 28 increasing contact and preventing fluid and ion leakage. The amount of such force can be experimentally derived by means known in the art.

Band 28 can be sized and made from a material so it expands on heating and applies the required compressive force at ambient or normal operating temperature of the connector 10. When heated, band 28 can fit over mounting portion 20 prior to the assembly of cable 12 and electrical elements 14. Upon cooling to ambient temperature, band 28 will provide the required radially inward force to seal against mounting portion 20. Encapsulant 24 can be formed over cable 12, elements 14, and mounting portion 20 with band 28.

It has been found that poly-ether-ether-ketone or "PEEK" is a suitable polymer for band 28. The polymer chosen for the making band 28 should be resistant to high pH conditions, and the constrictive force it places on the connector 16 should not be high enough to cause the polymer to yield. Band 28 can be machined, so that when heated for shrink fitting, the temperature is below that which would harm the polymer. Temperature for shrink fitting should be sufficient that the inner diameter of band 28 will expand to fit around the outer diameter of connector body 16 mounting portion 20. Once band 28 cools, it will maintain a constricting force around the circumference of mounting portion 20. Once in place, the connector body 16 mounting portion 20 and band 28 can be roughened preferably by sandblasting, cleaned, and overcoated with a primer. Primer aids in bonding encapsulant 24 to connector 16 mounting portion 20, elastomeric band 28, and cable 12.

Figure 3:
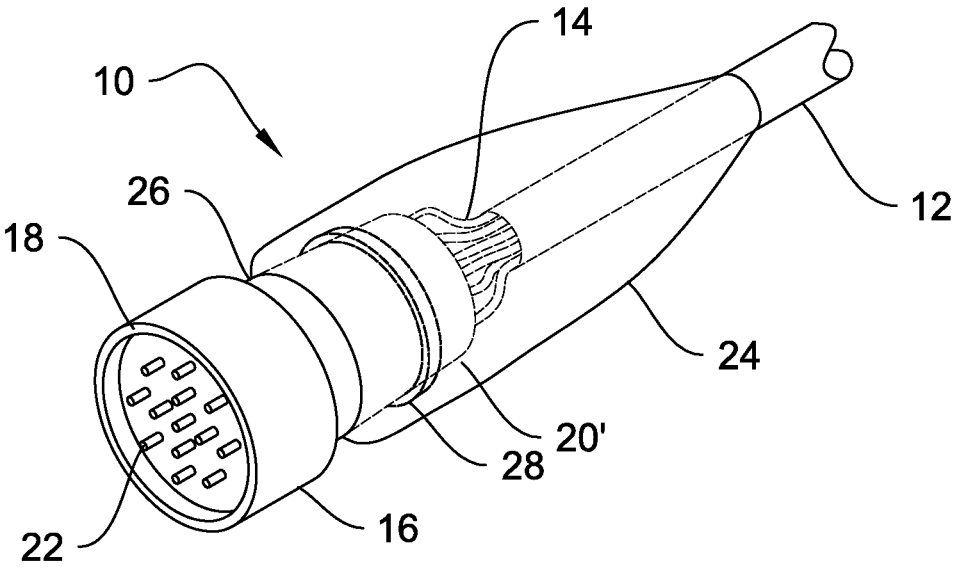
FIG. 3 is a diagram showing a second embodiment of a connector protected against cathodic delamination.

FIG. 3 illustrates a second embodiment. This embodiment provides an alternate method for fitting band 28 on connector body 16 mounting portion 20. As before, connector body 16 has a terminal connector 18 and a mounting portion 20'. Mounting portion 20' has a slight taper (1°-2°) to help position band 28. Mounting portion 20' has a smaller outer diameter on the end proximate to cable 12. Proximate to terminal connector 18, mounting portion 20' has a relatively larger outer diameter. A tapered surface extends from the mounting portion 20' end proximate cable 12 to the mounting portion 20' end proximate terminal connector 18. Band 28 can have an inner diameter sized to fit over the smaller outer diameter of mounting portion 20'. Band 28 can be positioned along mounting portion 20' by utilizing a lateral force to move band 28 to such a position wherein band 28 applies the required inwardly directed force. Position of band 28 along mounting portion 20' can be maintained by friction or by having a constant diameter region of tapered surface. A combination of heat shrink fitting and force fitting can also be used to assemble band 28 on mounting portion 20'. As before, the surface of the assembled connector 16 and band 28 can be treated, and encapsulant 24 can be applied.

Figure 4:
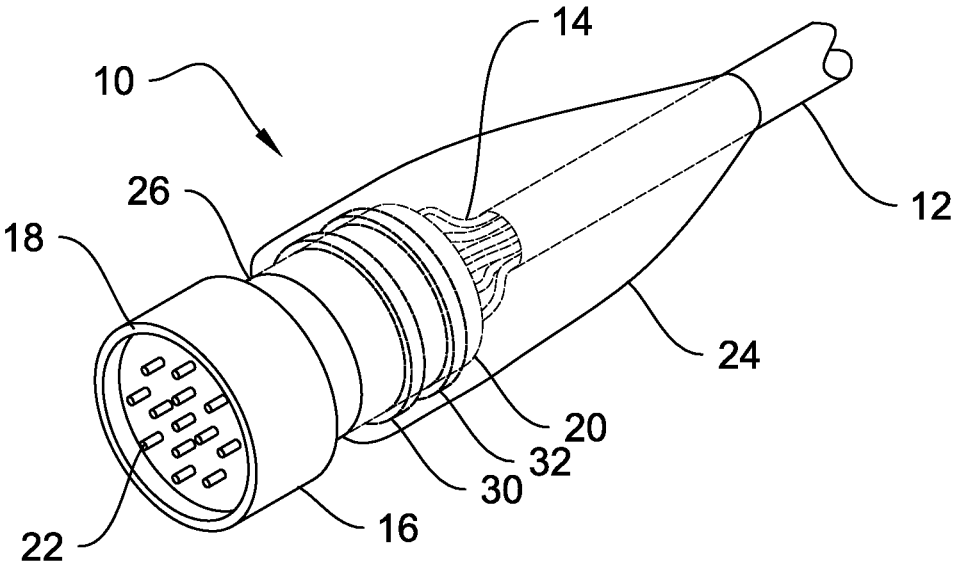
FIG. 4 is a diagram showing a third embodiment of a connector protected against cathodic delamination.

FIG. 4 shows another embodiment. In this embodiment, multiple internal elastomeric bands 30 and 32 are placed on the connector body 16 mounting portion 20 in series to provide an extra degree of protection from cathodic debonding. These bands 30 and 32 can be positioned by either one or both of the methods provided above.

The approach shown in these embodiments can be broadly applied. Internal bands, such as 28, can be designed for use on any round-cross-section connector 16 mounting portion 20. In addition, this approach does not require extensive reworking of the connector body 16 mounting portion 20 itself by machining threads or grooves into the connector body 16. As long as the primer and polyurethane remain bonded to band 28, and band 28 continues to exert a constrictive force on connector body 16 mounting portion 20, progression of cathodic debonding should be stopped.

An advantage of the internal band configuration is that it sits completely under the polyurethane encapsulant that would be present with or without the internal band. This means that the modification does not change the outer diameter or final shape of the finished connector 10. That, in turn, ensures that the banded connector will still fit in the space it was originally designed for. Expensive changes to other parts to make the banded connector 10 fit physically in a given space are not necessary.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive, nor to limit the invention to the precise form disclosed; and obviously, many modification and variations are possible in light of the above teaching. Such modifications and variations that may be apparent to a person skilled in the art are intended to be included within the scope of this invention as defined by the accompanying claims.

What is claimed is:

1. An electrical connector for joining a cable to a cathodically protected body in a marine environment comprising:

a connector body having a terminal connector for joining to the cathodically protected body and a mounting portion for receiving the cable;

an elastomeric band positioned around said connector body mounting portion and providing a radially inward force thereto; and an encapsulant formed around and bonded to said connector body mounting portion, said elastomeric band, and the cable;

wherein:

said elastomeric band has an inner diameter;

said connector body mounting portion has a first outer diameter less than said elastomeric band inner diameter at an end for receiving the cable and a second outer diameter greater than said elastomeric band inner diameter at an end proximate said connector body terminal connector, said connector body mounting portion having a continuous surface with varying outer diameter between the first outer diameter and the second outer diameter, said connector body mounting portion first outer diameter and said connector body mounting portion second outer diameter defining a taper of about 1°-2° along said connector body mounting portion from the end for receiving the cable to the end proximate said connector body terminal connector; and said elastomeric band being positioned on said connector body mounting portion continuous surface to give a radially inward force about said connector body mounting portion.

2. The apparatus of claim 1 wherein said elastomeric band comprises multiple elastomeric bands positioned about said connector body mounting portion.

3. The apparatus of claim 1 wherein said elastomeric band is positioned about said connector body mounting portion with sufficient radially inward force to prevent transfer of positive metallic ions from the marine environment to the region between said elastomeric band and said connector body mounting portion.

4. A method of making an improved marine connector comprising the steps of:

providing a connector body having a mounting portion and a terminal connector;

positioning an elastomeric band around said connector body mounting portion whereby said elastomeric band provides radially inward force about said connector body mounting portion;

receiving a cable having at least one element in said connector body mounting portion;

assembling the cable element to the connector body terminal connector; and molding an encapsulant about the assembled connector body mounting portion with the positioned elastomeric band and received cable such that the encapsulant is bonded to the connector body mounting portion, the elastomeric band, and the cable;

wherein:

said elastomeric band has an inner diameter; and said connector body mounting portion has a first outer diameter less than said elastomeric band inner diameter at an end for receiving the cable and a second outer diameter greater than said elastomeric band inner diameter at an end proximate said connector body terminal connector, said connector body mounting portion having a continuous surface with varying outer diameter between the first outer diameter and the second outer diameter, said connector body mounting portion first outer diameter and said connector body mounting portion second outer diameter having a taper of about 1°-2° along said connector body mounting portion from the end for receiving the cable to the end proximate said connector body terminal connector; and in the step of positioning, the elastomeric band is positioned on said connector body mounting portion continuous surface to give the radially inward force about said connector body mounting portion.

5. The method of claim 4 further comprising the step of heating the elastomeric band prior to the step of positioning.

6. The method of claim 4 further comprising the steps of:

preparing the surfaces of the assembled connector body mounting portion with the positioned elastomeric band and received cable prior to the step of molding; and applying a primer to the prepared surfaces of the assembled connector body mounting portion with the positioned elastomeric band and received cable prior to the step of molding.

* * * * *